United States Patent [19]

Kleinschmidt et al.

[11] 4,185,570

[45] Jan. 29, 1980

[54] APPARATUS FOR CONTROLLING THE EDGE OF A TUBULAR WORKPIECE

[75] Inventors: Johann O. Kleinschmidt, Karlsruhe; Konstantin Schwaab, Aichwald, both of Fed. Rep. of Germany

[73] Assignee: Union Special Corporation G.m.b.H., Stuttgart, Fed. Rep. of Germany

[21] Appl. No.: 922,256

[22] Filed: Jul. 5, 1978

[30] Foreign Application Priority Data

Jul. 5, 1977 [DE] Fed. Rep. of Germany ..... 2730291
Aug. 5, 1977 [DE] Fed. Rep. of Germany ..... 2735282

[51] Int. Cl.[2] ..... D05B 21/00

[52] U.S. Cl. ..... 112/121.26; 112/10; 112/121.27

[58] Field of Search ..... 112/121.26, 121.27, 112/10, 121.15, 121.12, 63, 2

[56] References Cited

U.S. PATENT DOCUMENTS

| | | | |
|---|---|---|---|
| 1,723,781 | 8/1929 | Hoggard | 112/121.26 X |
| 2,702,014 | 2/1955 | Brownstein | 112/2 |
| 3,426,708 | 2/1969 | Anderson | 112/121.26 |
| 3,759,199 | 9/1973 | Lee | 112/121.12 |
| 3,782,309 | 1/1974 | Lee | 122/121.27 X |
| 3,783,805 | 1/1974 | Guichard | 112/121.26 |
| 3,786,768 | 1/1974 | Kosrow et al. | 112/121.26 X |
| 3,865,058 | 2/1975 | Rovin et al. | 112/63 |
| 4,046,087 | 9/1977 | Manetti | 112/121.26 |
| 4,098,201 | 7/1978 | Adamski et al. | 112/121.26 |

*Primary Examiner*—H. Hampton Hunter
*Attorney, Agent, or Firm*—John A. Schaerli; John W. Harbst

[57] ABSTRACT

This invention relates to a device for controlling the edge of a tubular fabric. More particularly, this invention relates to a tubular fabric edge control device which controls the edge so that it can be hemmed by itself or in conjunction with an elastic tape.

10 Claims, 8 Drawing Figures

APPARATUS FOR CONTROLLING THE EDGE OF A TUBULAR WORKPIECE

BACKGROUND OF THE INVENTION

Devices for the support and guidance of a tubular fabric, such as men's briefs, during the construction thereof are known. Reference being made to German Pat. No. 11403022 and German Patent Applications Nos. 2514784 and 1072871. Additionally, devices are known that support, tension and guide of the edge of a tubular workpiece which is to be hemmed, for example, a man's T shirt.

A problem in many of these devices is accurately controlling the edge of the tubular garment with relationship to the needle. When an elastic band is also to be sewn to the edge of the tubular garment the additional problem of aligning the elastic band with the necessary amount of overlap between the two occurs. Generally the results have been accomplished by a certain amount of manual guidance or by the trimming of the edge of the tubular workpiece just prior to the sewing step.

SUMMARY OF THE INVENTION

The invention here under consideration is an apparatus used in combination with a sewing machine for tensioning and guiding in a predetermined manner the edge of a tubular workpiece such that it can be sewn. As stated previously, the edge can simply be folded and sewn creating a hem or length of the elastic and can be incorporated therewith. The apparatus comprises a series of semi-spherical means which have an axis of rotation, for example, balls having an axle passing through the center thereof. A frame means supports the semi-spherical means and may or may not carry a series of motor means. The motor means are associated with the semi-spherical means such that they can be rotated independently about a maximum of three perpendicular axes. The elastic carrying means also includes holding and stretching means whereby the elastic is carried over the workpiece in an aligned overlapping manner.

It is therefore, an object of this invention to provide a semi-spherical means which can be rotated independently about as many as three perpendicular axes over rotation.

Another object of this invention is to provide an apparatus which tensions and guides the edge of a tubular workpiece.

Still another object of this invention is to provide an apparatus which aligns a tubular fabric edge and an elastic band automatically such that their respective edges are accurately positioned for engagement by the sewing machine.

Another object of this invention is to provide an apparatus for aligning and tensioning a tubular garment which includes at least two semi-spherical members whose axes of rotation are adjustable with respect to each other.

But another object of this invention is to provide semi-spherical fabric tensioning and guiding means which can be rotated about the axis of rotation with sensor means for controlling the direction and amount of such rotation.

The invention will be further understood from the following description and drawings.

Figure 1:
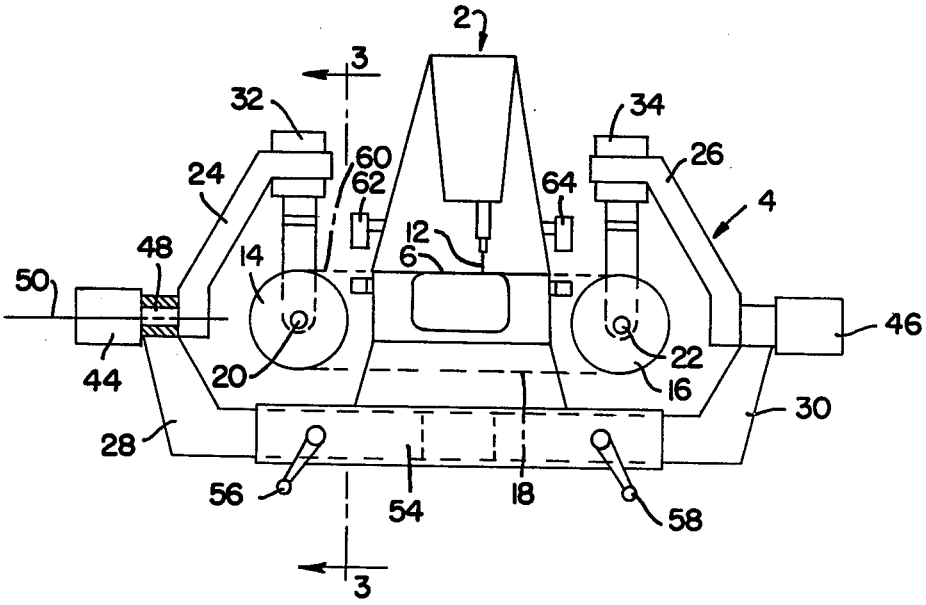
FIG. 1 is an elevational view of the head of a sewing machine having the tensioning and guiding apparatus associated therewith.

Referring now to FIG. 1 wherein the sewing machine means is shown in combination with the tubular fabric tensioning and guiding means 4. The sewing machine 2 is well known in the art and therefore no further discussion or reference will be made thereto with the exception to say that it is provided with a fabric of clothplate means 6, a needle hole 8, frame means 10 and a needle means 12.

The fabric tensioning and guiding means 4, in this particular embodiment, includes first and second semi-spherical means 14 and 16 which support a tubular fabric means 18. The semi-spherical means 14 and 16 are each independently carried on axle means 20 and 22, each of which constitute the axis of rotation of the respective sphere. The axles 20 and 22, as well as arm means 24 and 26, and support brackets 28 and 30 constitute the frame means which support the semi-spherical tensioning and guiding means.

Figure 2:
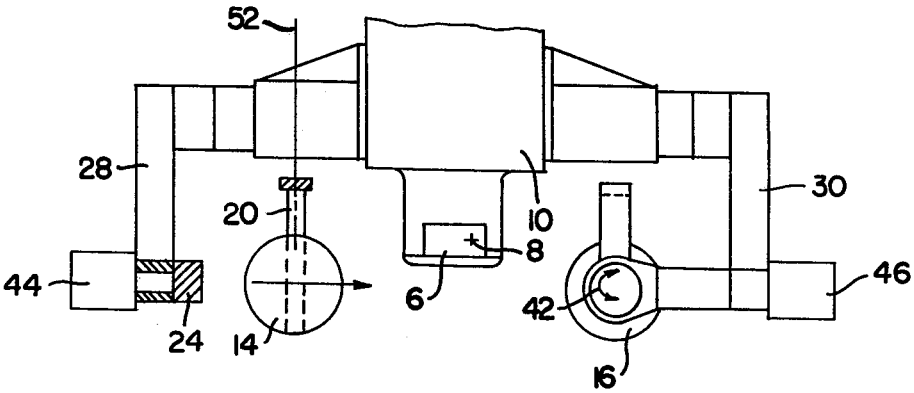
FIG. 2 is a plan view of the tensioning and guiding apparatus together with a portion of the sewing machine.
Figure 3:
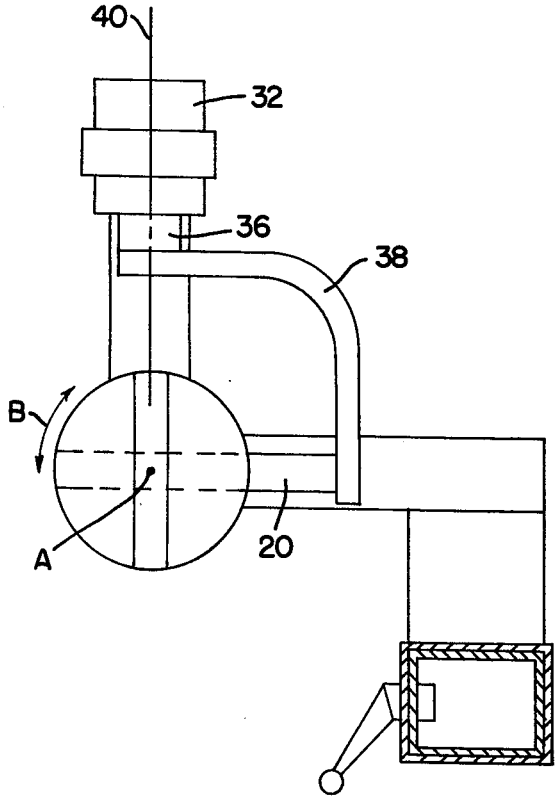
FIG. 3 is a portion of the tensioning and guiding apparatus for FIG. 2 taken along line 3.
Figure 4:
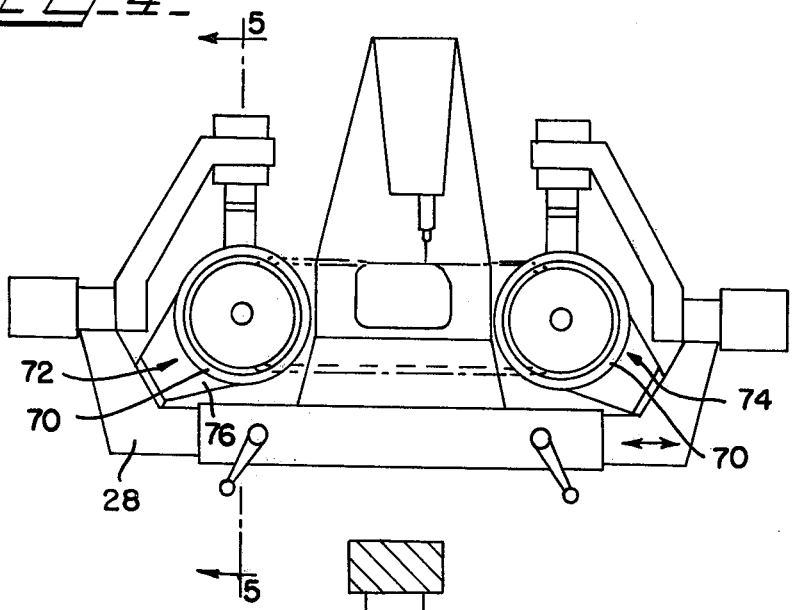
FIG. 4 is an elevational view of the head of the sewing machine showing the tensioning and guiding means as well as the elastic securing means.

Associated with arm means 24 and 26 are motor means 32 and 34. As shown in FIG. 3 the output shaft 36 of motor 32 carries a portion 38 of the arm means 24. The arm means 38 in turn carries the axle means 20. Thus, it is apparent that upon actuation of the motor means 32 the output shaft 36 rotates around the line 40, the axis of rotation of the semi-spherical means 14 can be varied. As shown in FIG. 2, associated with semi-spherical means 16, rotation will correspond to the line 42. It should be noted that the motors 32 and 34 are aligned with their shafts being perpendicular to the major axis of the respective axles 20 and 22. The sphere is thus rotated around a line which is perpendicular to the axis of rotation.

A second series of motor means 44 and 46 are associated with the brackets means 28 and 30. Referring to motor 44, it is apparent that the outward shaft 48 carries the arm means 24. Thus, upon actuation of the shaft 48 the arm means 24 rotates around the line of 50. It should be noted that both the line 40 and line 50 pass through the center of semi-spherical means 20. Thus it can be said that lines 40 and 50 are mutually perpendicular while a third line 52 along the major axis of axle 20 can be said to represent the third member of the coordinate system. Thus the semi-spherical means 14 can be rotated around lines 40, 50, or 52 either together or independently. All of this explanation holding equally true for the semi-spherical means 16 and its related elements.

Yet another adjustability feature is provided in that the frame means 28 and 30 are slideably supported in a holder means 54. Clamping means 56 and 58 are being provided to clamp the frame means once the desired spread is achieved.

As is apparent, the various motor means can be actuated in various amount such that tubular fabric 60 will be properly orientated on the clothplate 6 with respect to the needle 12. This alignment can be manually accomplished during a trial work cycle. Once the parameters are achieved for a given type of fabric, minor manual adjustments would be necessary thereafter to account for variation in the fabric, etc. However, when a different type of fabric would be used all of the parameters would have to be manually readjusted.

To avoid this manual adjustment each time a different type of fabric is worked with sensors such as 62 and 64 can be provided. These sensors with the necessary logic system can be employed to control the actuation or deactuation of the various motors to maintain the edge of the tubular fabric, or the combination of the tubular fabric and elastic band in a predetermined position.

In order to accomplish this result at least one sensor must be provided preferably in the region directly in front of the needle hole. That is, in the region where the tubular fabric is being fed into engagement with the needle. For example, sensor means 64 is generally located in this region. Because of this continuous monitoring of the tubular fabric's edge with the instant realignment of the axis of rotation of the semi-spherical means accurate alignment of the edge along a predetermined line can be achieved. In order to assist in accomplishing this result a second sensor means such as 62 may be arranged or located after the point of stitching to control, for example, the motors which orientate the semi-spherical means 14.

Referring now to FIGS. 4 through 8 where is disclosed the elastic tensioning and supporting assemblies which, as previously stated, may or may not be employed in conjunction with the tubular tensioning and guiding apparatus as discussed above. However, the construction of, for example, men's briefs, such an apparatus would be necessary to properly position and orientate the needed elastic band.

Figure 5:
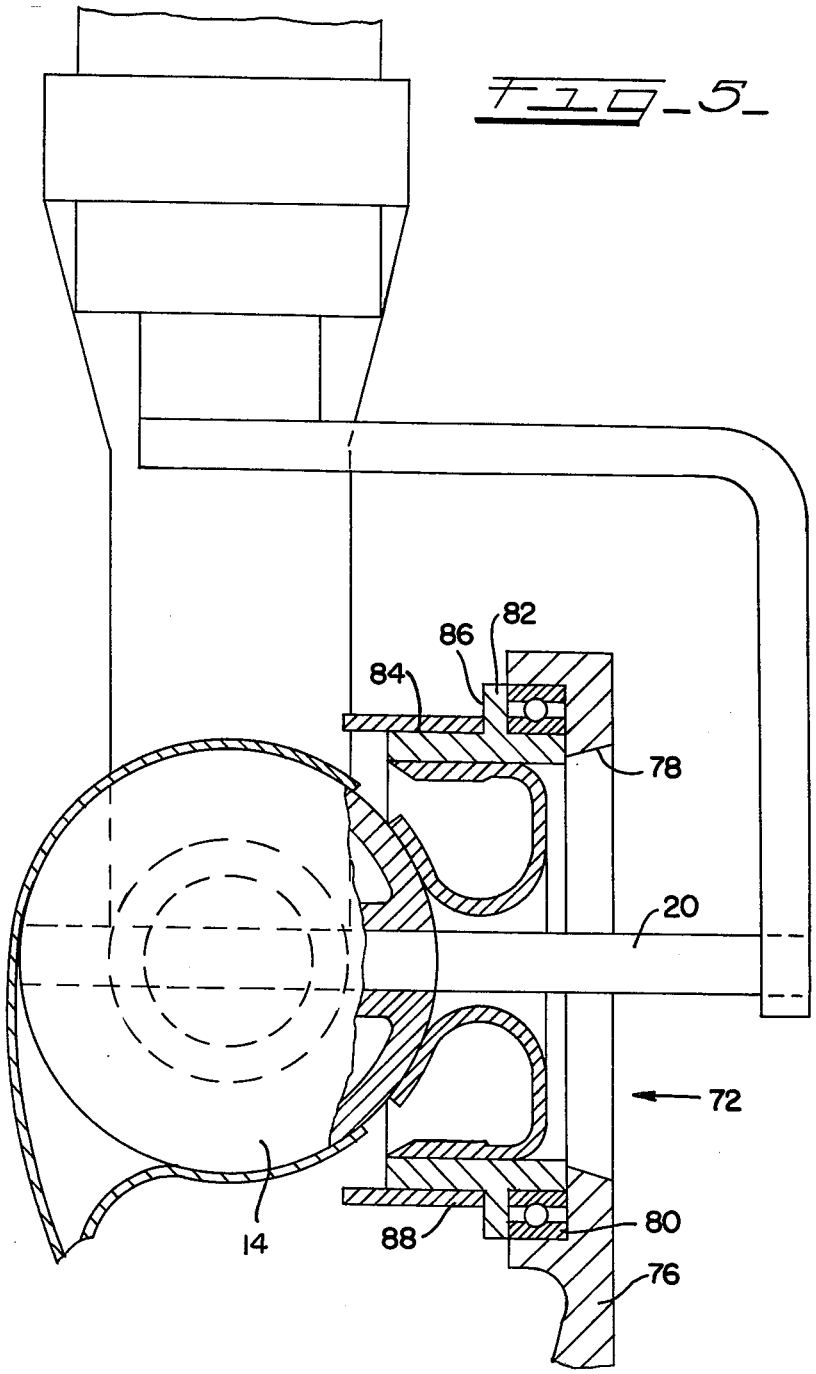
FIG. 5 is a partial enlarged scale section along lines 5—5 of FIG. 4.

The elastic tensioning and supporting means 70 includes two elastic carrying components 72 and 74. Referring now to FIG. 5 which just shows elastic carrying assembly 72. However, it should be appreciated that elastic carrying assembly 74 is substantially identical. In this particular embodiment the elastic carrying means 72 is secured to the arm means 28 via a bracket portion 76. The bracket portion 76 being provided with an aperture 78 therein to facilitate the passage of the axle means 20. Rotatably supported on rolling contact bearing means 80 is an annular ring means 82 which provides a support surface 84 as well as an edge guide surface 86 for the elastic band 88. As is apparent the elastic band means 88 is tensioned and positioned between the two supporting means 72 and 74. In this particular embodiment the positioning being manual. The elastic band as shown in FIG. 2, because of the narrow width of supporting surface 84, extends outwardly over the edge of the cylinder means 82 and overlaps the leading edge of the tubular workpiece which in turn is supported on the semi-spherical means 14. As previously discussed, the edge of the tubular workpiece is aligned by the semi-spherical means 14 until it achieves the proper predetermined orientation with the elastic means 88. In this particular embodiment the semi-spherical means 14 and 16 are not driven but rotate freely around their respective axles. The driving force being provided by the feed dog system associated with the sewing machine, which move the fabric, which in turn cause the semi-spherical means to rotate.

Both of these members, that is the tubular fabric means and the elastic band are positioned on the clothplate 6 whereby the sewing function can be performed.

Figure 8:
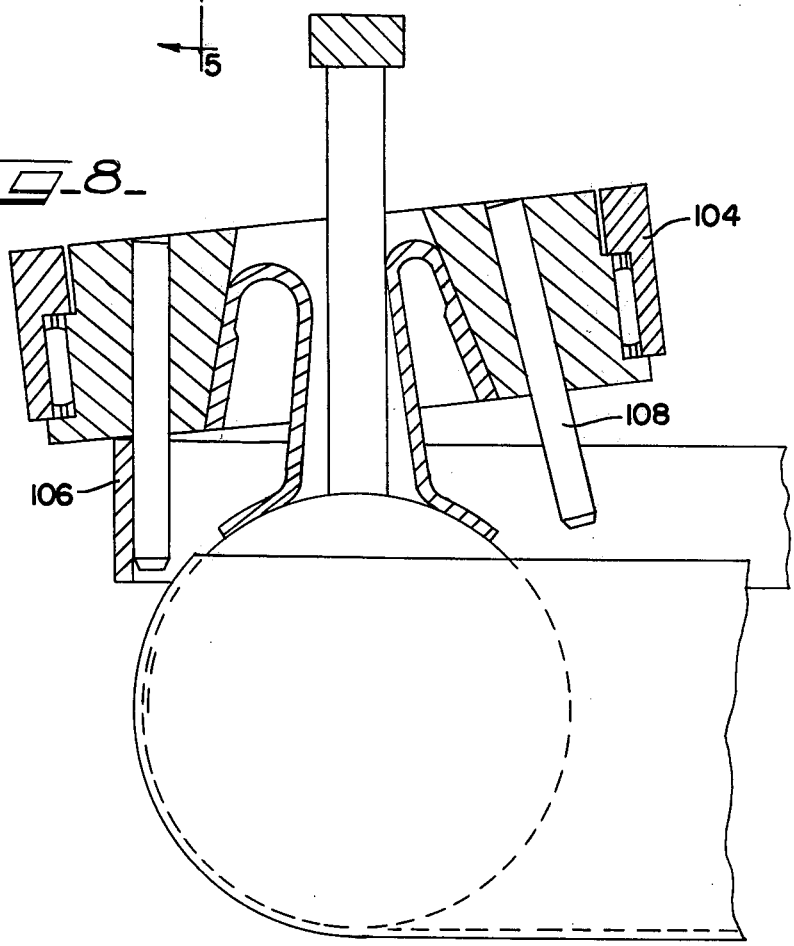
FIG. 8 is a horizontal section showing still a further embodiment of the fabric tensioning and guiding device in combination with the elastic securing means.
Figure 6:
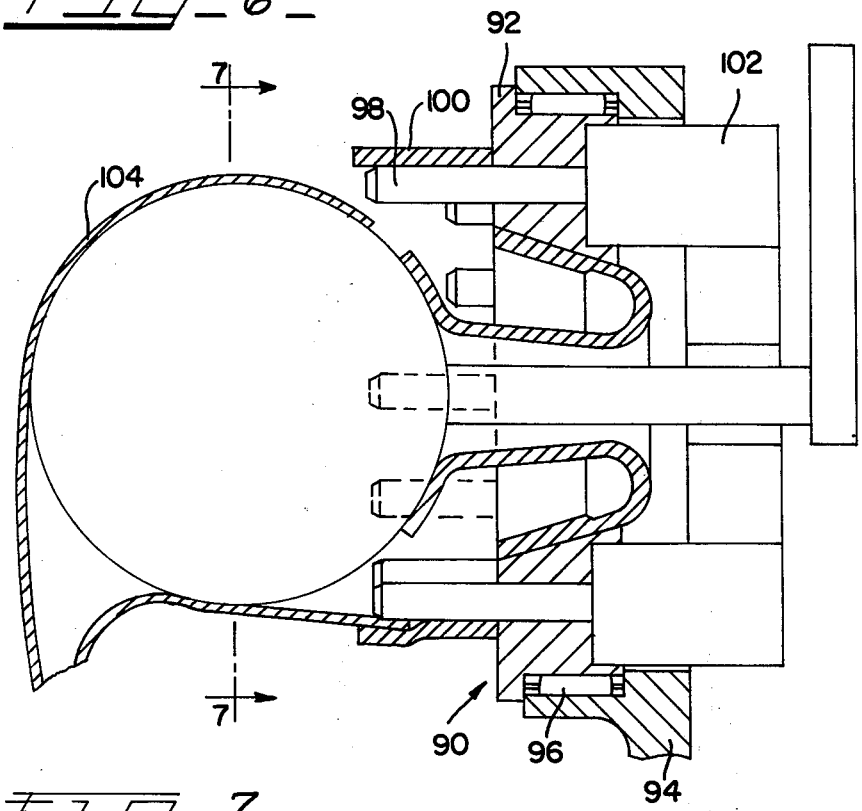
FIG. 6 shows a second embodiment of the device shown in FIG. 5.
Figure 7:
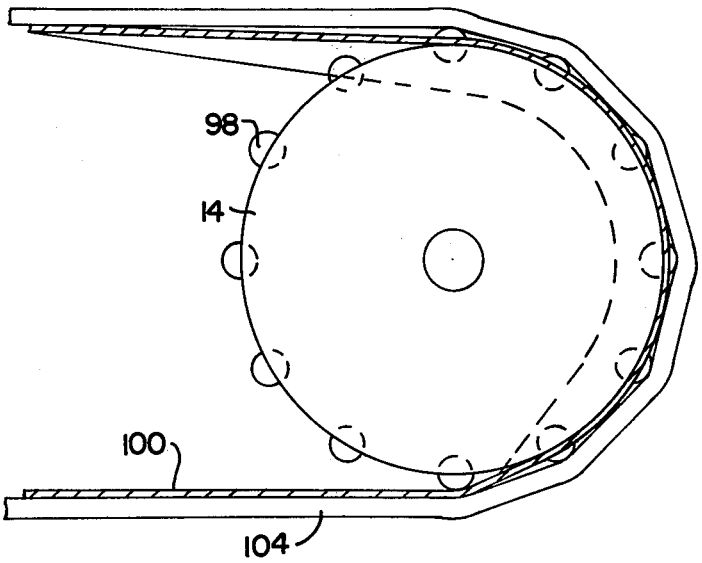
FIG. 7 is a section along the line 7—7 of FIG. 6.

Further embodiments of the elastic supporting devices are shown in FIGS. 6, 7 and 8. For example, in FIG. 6 the elastic supporting member 90 comprises an annular ring 92 supported on the bracket 94 via roller bearings 96 such that free rotation is possible therebetween. Pin means 98 are provided for carrying the elastic band 100 in an overlapping position. The pin means 98 are connected to respective armatures of magnet means 102 and are shorter than the overall width of the band. The magnet means 102 serve to retract the pin means 98 at the point where, as the annular ring 194 rotates, the pins must pass between the edge of the tubular workpiece 104 and the elastic band 100. Of course, the pin means 98 may have moved position by means of pneumatic cylinders or operating cams (not shown) instead of by means of magnets.

As is shown in FIG. 7 the edges of the tubular workpiece 104 is lifted from the semi-spherical means 14 onto the pins 98 by the elastic band 100 when the beginning of the sewn seam reaches the retraction point of the pins 98. When the beginning of the seam arrives at the take-off point the pins 98 are retracted, as for example, by the magnet means 102 in order to prevent the pins from deforming the edge of the workpiece in this region and preclude uniform feeding to the sewing point. That is, the pins must be removed such that they can come up under the sewn portion and not become entangled between the elastic band and tubular fabric means at the point where the two have been sewn together.

FIG. 8 shows still another embodiment in the elastic band means 90 and is similar to that shown in FIGS. 5, 6 and 7. However, in this case, the bracket means 104 is inclined to the point of motion of the elastic band means 106 and the pin means 108 are arranged in the form of a cone. Because of the cone arrangement the pin means 108 are automatically retracted for a given period of the cycle and thereby avoid the entailment with the sewn hem.

Thus it is apparent that there has been provided, in accordance with the invention, an automatic apparatus for tensioning and guiding the edge of tubular fabric that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. An apparatus in combination with a sewing machine for tensioning and guiding in a predetermined manner an edge of a tubular workpiece such that it can be sewn comprising:

semi-spherical means having an axis of rotation;

frame means supporting said semi-spherical means; and motor means associated with said frame means whereby said semi-spherical means can be rotated independently about any of three perpendicular axis.

2. An apparatus in combination with a sewing machine for tensioning and guiding in a predetermined manner an edge of a tubular workpiece such that it can be sewn comprising;

at least two spherical means each having an axis of rotation;

frame means supporting said spherical means; and first, second and third motor means associated with each of said spherical means whereby said spherical means can be rotated independently about any of three perpendicular axis.

3. The apparatus of claim 1 wherein:

said sewing machine includes a fabric supporting means; and fabric edge sensor means positioned adjacent said fabric supporting means providing information to a control system means, said control system means directing the actuation and deactuation of said motor means.

4. The apparatus of claim 1 wherein said semi-spherical means is provided with areas having different coefficients of friction.

5. The apparatus of claim 1 wherein said frame means is movable with respect to said sewing machine.

6. In combination with a sewing machine an apparatus for guiding the edge of a tubular fabric piece upon which work is to be performed comprising:

at least two semi-spherical means having axis of rotation and being rotatable therearound;

frame means carrying said semi-spherical means whereby they can be rotated independently about any of two perpendicular axes of rotation; and motor means associated with said frame means for actuating independent rotation.

7. An elastic tensioning and supporting means in combination with a sewing machine and tubular fabric tensioning and guiding means comprising:

a series of elastic carrying means which include a means for aligning an edge of said elastic in a predetermined manner and means supporting the elastic which is retractable.

8. An elastic tensioning and supporting means for stretching an elastic band in combination with a tensioning and guiding means for preparing tubular fabric for sewing on a sewing machine comprising:

a series of elastic carrying means including edge guide means and elastic support means, whereby the elastic band can be aligned in a predetermined manner with respect to the tubular fabric; and means operative to allow rotation of said elastic carrying means.

9. The elastic tensioning and supporting means of claim 8 wherein:

said elastic carrying means can be adjusted with respect to said tensioning and guiding means.

10. The elastic tensioning and supporting means of claim 9 wherein:

said elastic carrying means includes axle means which can be adjusted with respect to said tensioning and guiding means.

* * * * *